United States Patent [19]

Diebold

[11] Patent Number: 4,571,202

[45] Date of Patent: Feb. 18, 1986

[54] ELECTRICALLY POWERED MODULAR TOY SET

[75] Inventor: Camille Diebold, Bischoffsheim, France

[73] Assignee: Joustra S.A., France

[21] Appl. No.: 577,056

[22] Filed: Feb. 6, 1984

[30] Foreign Application Priority Data

Feb. 10, 1983 [FR] France ..... 83 02287

[51] Int. Cl.[4] ..... A63H 33/04

[52] U.S. Cl. ..... 446/90; 446/94; 446/462

[58] Field of Search ..... 446/90, 91, 93, 94, 446/95, 96, 431, 432, 433, 434, 438, 439, 454, 455, 457, 462, 463, 424, 427, 428, 484, 485

[56] References Cited

U.S. PATENT DOCUMENTS

| | | | |
|---|---|---|---|
| 1,914,323 | 6/1933 | Boisselier | 446/439 |
| 2,829,285 | 4/1958 | Steiner et al. | 446/145 X |
| 3,538,640 | 11/1970 | Hayes et al. | 446/454 |
| 3,553,885 | 1/1971 | Tazaki | 446/485 X |
| 4,411,098 | 10/1983 | Birdsall et al. | 446/471 X |

*Primary Examiner*—Mickey Yu

*Attorney, Agent, or Firm*—Hayes, Davis & Soloway

[57] ABSTRACT

The present invention concerns a toy set consisting of a base unit (10) having a chassis (11) supporting an electric motor (12), and two axles (15). At least one of the axles has a pair of wheels (14) and the other axle has one or two wheels (14). At least one of the axles is mechanically coupled to the output shaft of the motor (12). Completing the base unit is a source of electrical energy (13) such as a storage battery, and at least one electrical outlet, socket or plug (17). The electrical outlet, socket or plug (17) is designed to be connected, via an electrical connector of suitable mating configuration, to the electric motor of an accessory or apparatus complementary to the vehicle. A control lever (16) is provided for controlling forward motion, backward motion and stopping the vehicle. The base unit may be equipped with different vehicle bodies to form different types of vehicles.

8 Claims, 5 Drawing Figures

ELECTRICALLY POWERED MODULAR TOY SET

The present invention relates to toys, and more particularly relates to toy sets comprising at least one miniature reproduction of a vehicle or of a motorized engine, and a miniature reproduction of at least one accessory or apparatus complementary to the vehicle or motorized engine. Modular toys comprising a chassis adaptable to motors, pulling means, drive means and at least one vehicle are already known. Often this type of toy is designed for older children and resembles a model more than a simple toy suitable for younger children.

The present invention provides a toy set, comprising a single base unit, and having a series of vehicles or motorized engines associated with a range of accessories which also may be motorized.

More particularly, in accordance with the invention there is provided a toy set comprising a vehicle or motorized engine which includes an electrical outlet, socket or plug, and an accessory complementary to the vehicle, and comprising an electric motor and means for attaching the motor to the electrical outlet, socket or plug.

According to a preferred embodiment of the invention, the toy set comprises (1) at least one base unit comprising (a) a chassis supporting an electric motor, (b) at least two axles, one of which axles being equipped with two wheels and the other axle being equipped with one or two wheels, at least one of the axles being mechanically coupled with the output shaft of the electric motor, (c) an electrical energy source, and (d) an electrical outlet, socket or plug mounted on the vehicle; and (2) at least one vehicle body for equipping the chassis. Using the base unit and the different vehicle bodies, a child may make a whole range of very different vehicles.

The vehicle body preferably also has means for mechanically attaching accessories or complementary apparatus.

Preferably, the chassis is reversible, so it may be used in one direction or the other, according to which body is used. This is particularly preferred, since it permits considerable variation in the range of vehicles which can be made, and thus permits accommodation of a relatively large number of different bodies. For example, the base unit may be used in one direction when equipped as a truck, firetruck, camper, etc., and in the other direction when equipped as a tractor, flatbed truck, etc. The base unit also has a control means, preferably a pivotable lever, for selectively controlling at least the following functions: forward motion, backward motion and stopping.

To permit use of several base units with a single source of electrical energy, each base unit comprises an electrical outlet, socket or plug connected to the motor terminals to allow coupling, via an electrical connector of suitable mating configuration, the electrical source from one base unit with the motor of another base unit. This arrangement, for example, permits the vehicle to be used as a tow truck to pull a second vehicle so the child may simulate a car breakdown.

The present invention will be better understood with reference to the description of embodiments thereof and to the attached drawing, in which.

Figure 1:
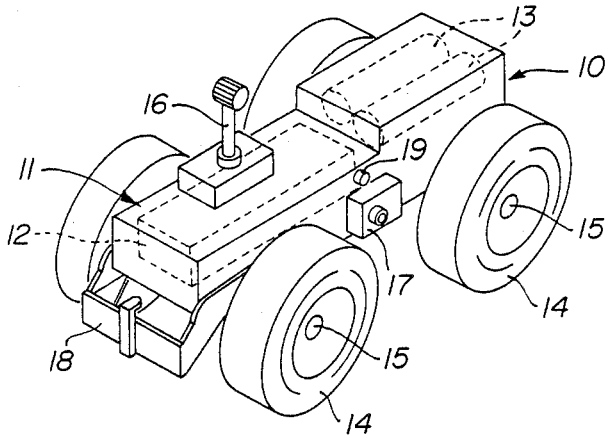
FIG. 1 is a perspective view of a base unit of a toy vehicle made according to the invention.

With reference to FIG. 1, a base unit 10 comprises chassis 11, for example, of molded synthetic (plastic) material. Chassis 11 supports an electric motor 12 and a source of electrical energy consisting, for example, of one or a series of dry cell batteries or storage batteries 13. Four wheels 14 are mounted two each on two axles 15 affixed to the chassis. At least one axle 15 is mechanically coupled with the output shaft (not shown) of motor 12. Chassis 11 also carries a pivotable control lever 16 for controlling forward motion, backward motion and stopping of the vehicle. An electrical outlet, socket or plug 17 is mounted on one of the chassis surfaces for electrically coupling, via an electrocal connector of suitable mating configuration, the source of electrical supply carried by the base unit chassis with accessories associated with another vehicle (see FIGS. 4 and 5). An arched pivot 18 is mounted at one end of the chassis for mechanical coupling the base unit to different complementary apparatus accessories such as a sander as shown in FIG. 5.

A second electrical connector 19 of suitable mating configuration may be provided to allow motor 12 to be supplied with electrical current from an exterior source, for example from the energy source of another base unit.

Figure 2:
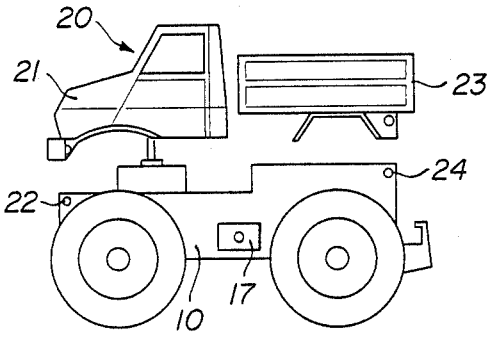
FIGS. 2 and 3 are schematic illustrations of two examples of toy vehicles made by equipping the base unit of FIG. 1.

FIG. 2 shows a base unit 10 onto which a truck body 20 has been positioned, comprised of a cab 21, for example, of molded synthetic (plastic) material, positioned at the front end of base unit 10, and held in place on the chassis by two lateral projections 22, and a cargo carrying portion 23 which is similarly positioned at the rear end of base unit 10, and held in place on the chassis by two lateral projections 24.

Figure 3:
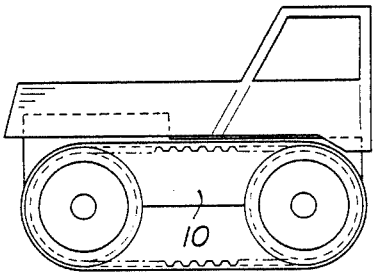

FIG. 3 shows the same base unit 10 but used in the other (reversed) direction to receive vehicle body 30 which makes the unit into a caterpillar tractor.

Figure 4:
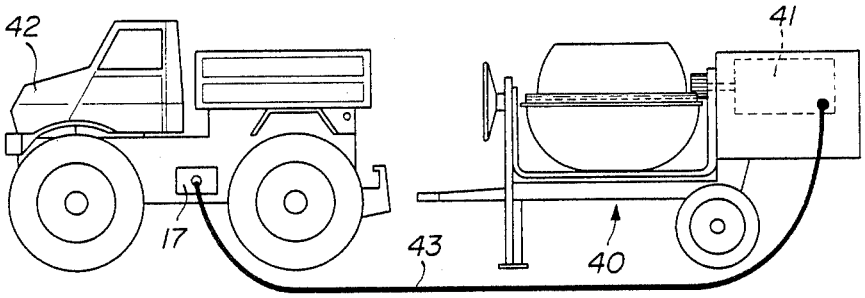
FIG. 4 shows one of the accessories which may be attached to a toy vehicle made by equipping the base unit of FIG. 1.
Figure 5:
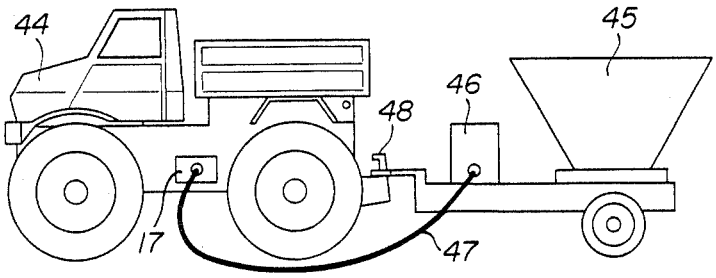
FIG. 5 shows, by way of example, another accessory coupled with the toy vehicle made using the base unit of FIG. 1.

FIG. 4 shows a toy vehicle similar to that shown in FIG. 2, to which there has been added a concrete mixer 40, the motor 41 of which concrete mixer being supplied by the same electrical source as vehicle 42 through an electrical connector 43 which is plugged into outlet 17. Outlet 17 is mounted on the base unit, and together with cab 21 and cargo carrying portion 23 form vehicle 42.

FIG. 5 shows another toy vehicle made in accordance with the invention, and comprising a truck 44 pulling a sander 45. The motor 46 of sander 45 is supplied by the same electrical source as vehicle 44 through an electrical connector 47 which is plugged into electrical outlet 17 of truck 44. Outlet 17 is mounted on the base unit of the truck 44 as before. Sander 45 also is mechanically connected to the base unit of truck 44 by a hook 48 which is mounted on the base unit on the side opposite arch 18.

Naturally, the present invention is not limited to the embodiments described. For example, a series of tricycle-type toy vehicles may be made by equipping one of the axles of the base unit with one wheel rather than two wheels as has been illustrated. Still other modifications may be made as will be obvious to one skilled in the art.

I claim:

1. A modular toy set comprising at least one miniature reproduction of a motorized vehicle chassis, and a miniature reproduction of at least one motorized accessory complementary to the said chassis, said chassis includng an electric motor having an output shaft, and having means for accommodating an electrical energy storage battery for supplying electrical energy to said motor; and an electrical outlet mounted thereon, and said accessory complementary to the said chassis including an electric motor having an output shaft, means for electrically connecting said motor of said accessory with said electrical outlet on said chassis and mechanical means for attaching said accessory to said chassis.

2. A toy set according to claim 1, wherein said chassis comprises (1) at least two axles, at least one of which axles being equipped with a pair of wheels and the other axle being equipped with at least one wheel, at least one of said axles being mechanically connected with the output shaft of said electric motor of said chassis and (2) at least one vehicle body for equipping the chassis.

3. A toy set according to claim 2, wherein each axle is equipped with a pair of wheels.

4. A toy set according to claim 2, and including at least one electrical energy storage battery mounted in said means for accommodating.

5. A toy set according to claim 2, wherein said chassis is adaptable for accommodating different vehicle bodies.

6. A toy set according to claim 2, and further including a control means mounted on said chassis for controlling at least forward motion, backward motion and stopping the vehicle.

7. A toy set according to claim 2, wherein said electrical outlet is connected to terminals of said chassis motor to allow connection, via an electrical connector of a suitable mating configuration, of an exterior electrical energy source with the motor of said chassis.

8. A toy set according to claim 7, wherein said exterior electrical energy source comprises an electrical energy source from another chassis.

* * * * *